US007857030B2

(12) United States Patent
Cheng

(10) Patent No.: US 7,857,030 B2
(45) Date of Patent: Dec. 28, 2010

(54) WINDOW COVERING SWITCHABLE TO MANUAL OPERATION AND ELECTRICAL OPERATION AND A CLUTCH THEREOF

(76) Inventor: Li-Ming Cheng, No.215, Jiouru 1st Rd., Sanmin Dist., Kaohsiung (TW)

( * ) Notice: Subject to any disclaimer, the term of this patent is extended or adjusted under 35 U.S.C. 154(b) by 446 days.

(21) Appl. No.: 11/825,967

(22) Filed: Jul. 10, 2007

(65) Prior Publication Data

US 2009/0014132 A1 Jan. 15, 2009

(51) Int. Cl.
*E06B 9/32* (2006.01)

(52) U.S. Cl. ..... 160/168.1 P; 160/170; 160/84.02

(58) Field of Classification Search ..... 160/168.1 P, 160/170, 176.1 P; 242/390.8
See application file for complete search history.

(56) References Cited

U.S. PATENT DOCUMENTS

| | | | | | |
|---|---|---|---|---|---|
| 2,251,633 | A * | 8/1941 | Panish | 74/625 |
| 2,724,289 | A * | 11/1955 | Wight | 74/625 |
| 3,026,744 | A * | 3/1962 | Rouse | 74/625 |
| 3,750,491 | A * | 8/1973 | Herrmann | 74/625 |
| 4,644,990 | A * | 2/1987 | Webb et al. | 160/5 |
| 4,893,557 | A * | 1/1990 | Benthake et al. | 101/141 |
| 5,531,257 | A * | 7/1996 | Kuhar | 160/168.1 P |
| 5,611,386 | A * | 3/1997 | Wang | 160/344 |
| 6,055,885 | A * | 5/2000 | Shea | 74/625 |
| 6,056,219 | A * | 5/2000 | Barkley | 242/225 |
| 7,517,609 | B2 * | 4/2009 | Cheng | 429/97 |
| 2007/0012407 | A1 * | 1/2007 | Nien et al. | 160/170 |
| 2009/0014132 | A1 * | 1/2009 | Cheng | 160/168.1 P |

* cited by examiner

*Primary Examiner*—Blair M. Johnson
(74) *Attorney, Agent, or Firm*—Muncy, Geissler, Olds & Lowe, PLLC

(57) ABSTRACT

A window covering switchable to manual operation and electrical operation includes at least an upper elongated member, a lower elongated member, a shade lift cord assembly, an electric transmission assembly, a clutch and an automatic retraction means. The electric transmission assembly is coupled with the clutch through an axle of a gear box to drive a driving gear thereon to rotate. The driving gear is engaged with a driven gear pivotally coupled with the automatic retraction means to form a synchronous transmission thereby to control retraction and extension of the electric window covering. When electric power is not available manual operation may be switched through the clutch to extend or retract the window covering.

2 Claims, 13 Drawing Sheets

WINDOW COVERING SWITCHABLE TO MANUAL OPERATION AND ELECTRICAL OPERATION AND A CLUTCH THEREOF

FIELD OF THE INVENTION

The present invention relates to a window covering switchable to manual operation and electrical operation and particularly to a window covering that has a shade assembly driven manually and electrically through a clutch.

BACKGROUND OF THE INVENTION

There are many types of window coverings available on the market, such as blinds, pleated shade, roman shade and the like. They mainly are installed on windows or doors in houses to block sunshine and provide decorative function. While consumer's requirements may be different, safety always is an important issue. Taking this issue into account, an electrically driven window covering usually is adopted to control rising up or lowering down of the window covering. However, the electric window covering still has problems when in use, notably:

1. When the conventional electric window covering is in a no power condition the motor and gear box are not functioning, lowering down or rising up the window covering by hands is difficult.

2. When the conventional electric window covering is in a no power condition to lower down or roll up the window covering at a desired elevation and anchored there is more difficult. As a result the practicality of the window covering suffers.

SUMMARY OF THE INVENTION

The primary object of the present invention is to provide a window covering that can be switched to manual operation and electrical operation to improve the shortcomings of the conventional electric window covering that cannot be rolled up or lowered at a desired elevation manually when electric power is not available. The invention includes an electric transmission assembly which has a control module at an upper side containing a battery. By depressing a pushbutton a driving gear in a clutch is lowered to engage with a driven gear to perform transmission synchronously to control rising up and extension of the window covering electrically. When electric power is not available the battery can be removed to move the driving gear higher to disengage with the driven gear, and the window covering can be extended or rolled up by switching to a manual operation.

Another object of the invention is to provide a clutch for electric window coverings to improve the problem of the conventional electric window covering that cannot be rolled up or extended the window covering at a desired elevation manually when the electric power is not available. The electric transmission assembly includes a gear box which has an axle connecting to the clutch. By depressing the pushbutton the driving gear in the clutch is lowered to engage with the driven gear to do transmission synchronously to control rising up and extension of the window covering electrically. When the pushbutton is released the driving gear is moved higher to disengage with the driven gear, and the window covering can be extended or rolled up by switching to the manual operation.

To achieve the foregoing objects the window covering switchable to manual operation and electrical operation of the invention includes at least an upper elongated member, a lower elongated member, a shade lift cord assembly, an electric transmission assembly, a clutch and an automatic retraction means. The electric transmission assembly, clutch and automatic retraction means are located in the upper elongated member. The electric transmission assembly can be coupled with the clutch through an axle of a gear box. Through a driving gear pivotally coupled on the clutch, a driven gear can be engaged to provide synchronous transmission.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
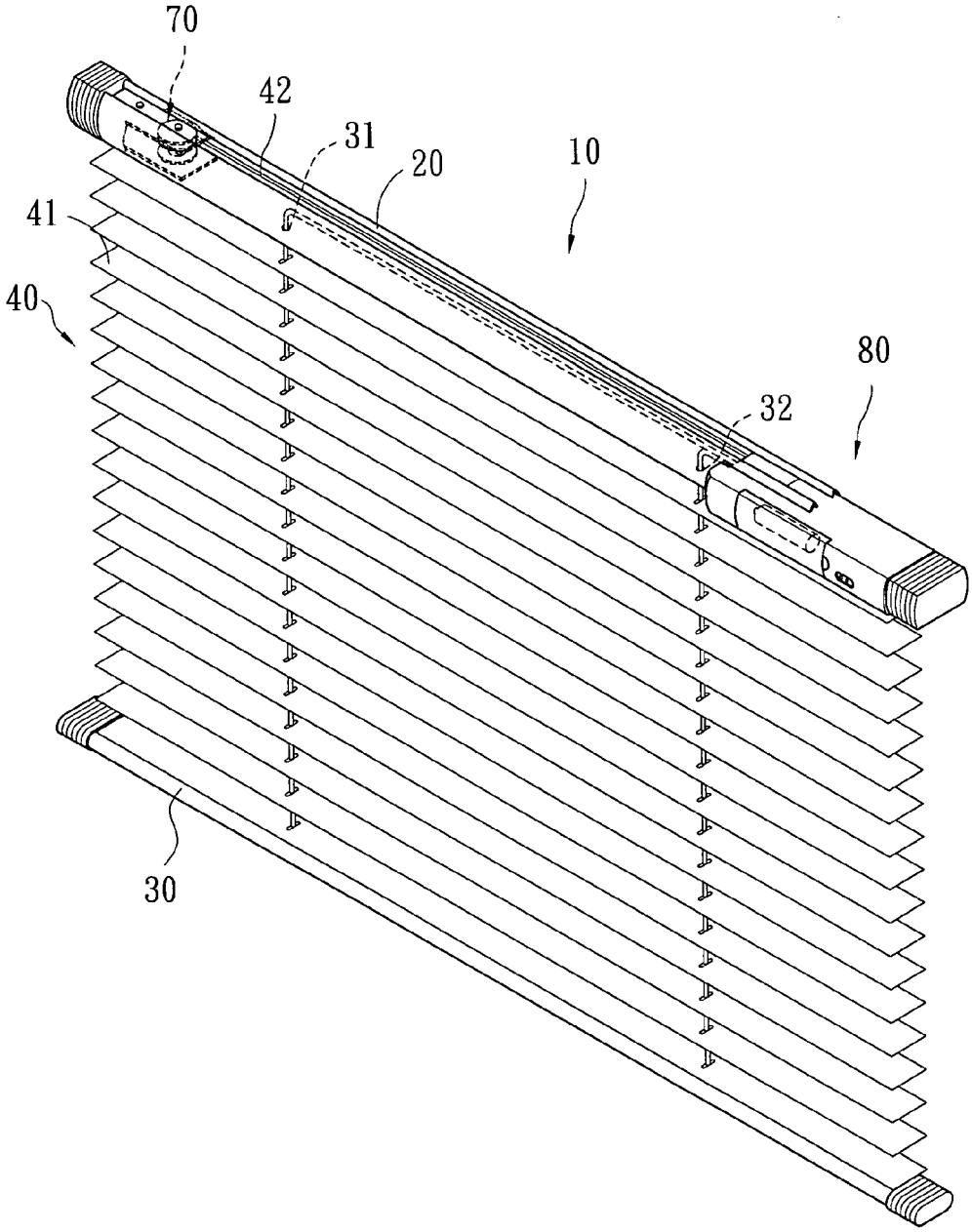
FIG. 1 is a perspective view of the invention.
Figure 2:
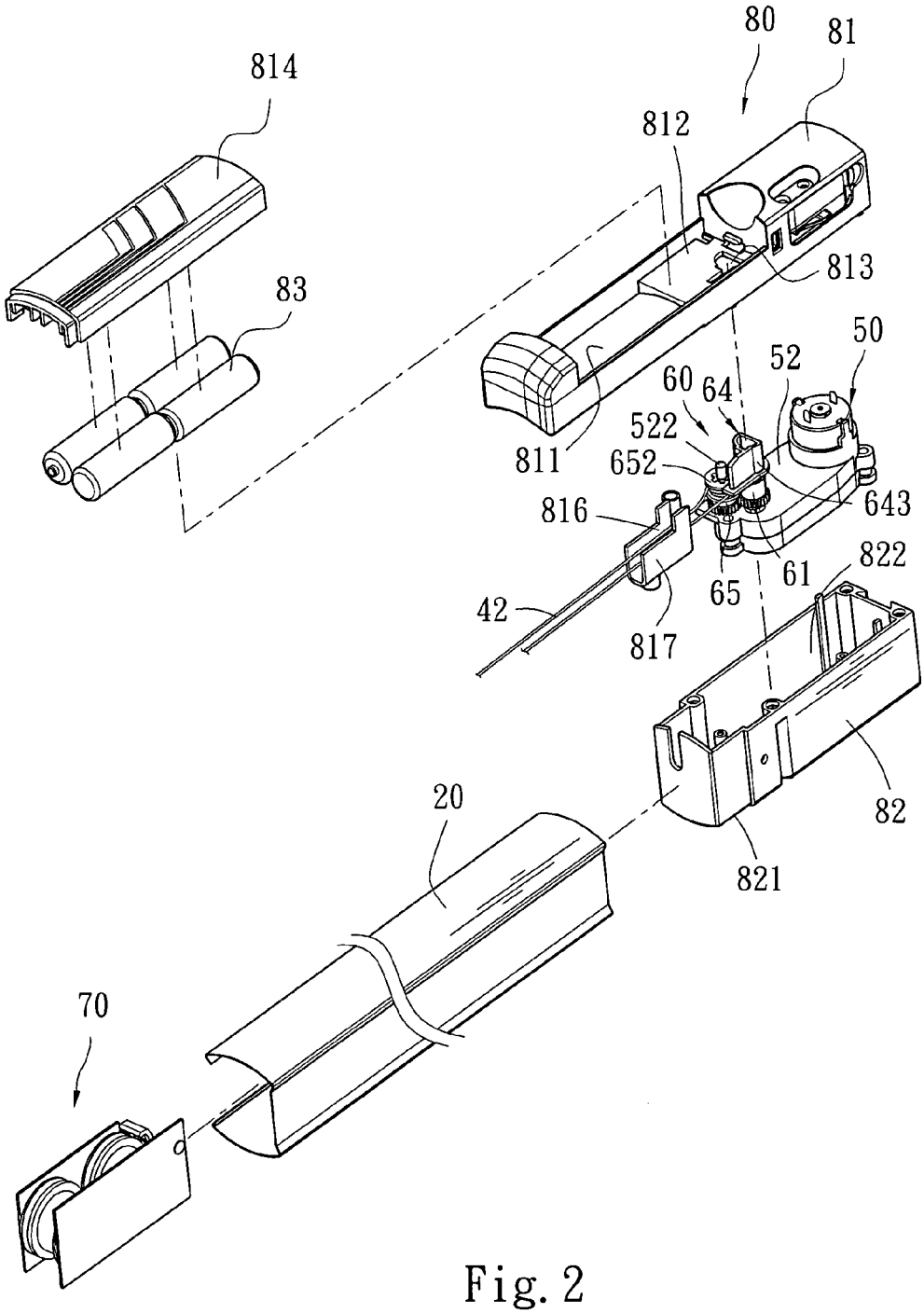
FIG. 2 is an exploded view of an upper elongated member of the invention.

Please refer to FIGS. 1 and 2, the electric window covering 10 of the invention includes an upper elongated member 20 which holds an automatic retraction means 70 at one side. The automatic retraction means 70 is coupled with a clutch 60 and an electric transmission assembly 50. Thus the automatic retraction means 70 and the clutch 60 are engaged to form a synchronous transmission. As a result, the electric window covering 10 originally driven electrically can be switched to manual operation through the clutch 60 to roll up and extend the window covering 10. In an embodiment shown in the drawings the electric window covering 10 mainly includes the upper elongated member 20, a lower elongated member 30, a shade lift cord assembly 40, the electric transmission assembly 50, the clutch 60 and the automatic retraction means 70.

The upper elongated member 20 is a hollow and elongate rail with two ends having respectively an opening 31 and 32 formed thereon.

The lower elongated member 30 is another elongate rail spaced from the upper elongated member 20 at a lower side.

The shade lift assembly 40 is located between the upper elongated member 20 and the lower elongated member 30, and includes mainly shade 41 and a lift cord assembly 42. The shade 41 may be shade of a Venetian blind or a pleated shade. The shade 41 shown in the embodiment of the drawings are shade of a Venetian blind. They are linked to the upper elongated member 20 and the lower elongated member 30. The lift cord assembly 42 has one end fastened to the automatic retraction means 70 at one side of the upper elongated member 20 and other end threaded through the openings 31 and 32 and the shades 41 to be fastened to the lower elongated member 30.

Figure 3:
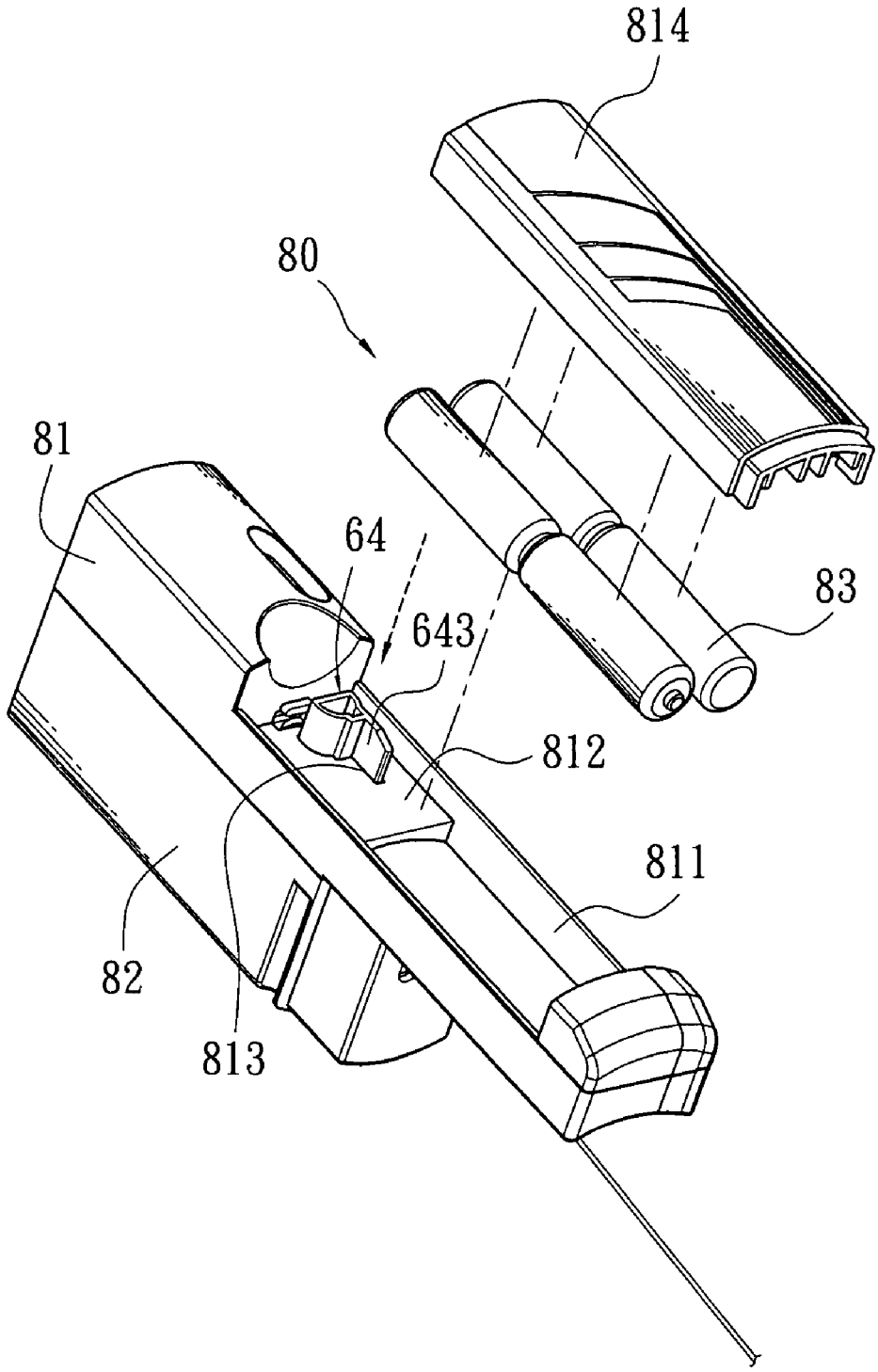
FIG. 3 is an exploded view of a control module of the invention.
Figure 5:
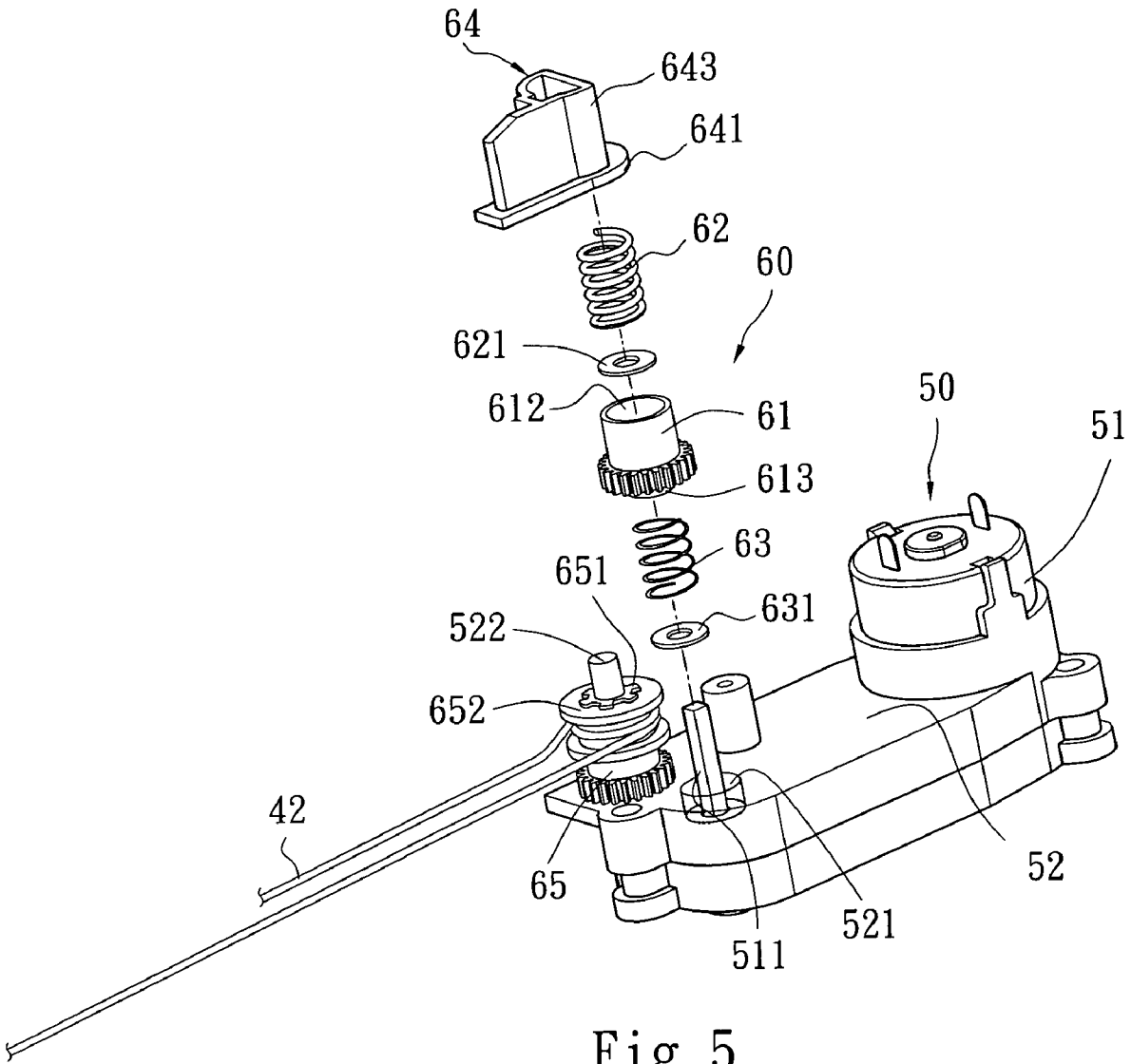
FIG. 5 is an exploded view of a clutch of the invention.

Also referring to FIGS. 2, 3 and 5, the electric transmission assembly 50 is located in a control module 80 at another side of the upper elongated member 20. It mainly includes a motor 51 and a gear box 52 coupled with a motor 51. The motor 51 is located at one end of the gear box 52. The gear box 52 has an axle 511 running through a recess 521 formed at another end of the gear box 52. The gear box 52 has an anchor shaft 522 at another end to be wound by the lift cord assembly 42.

Also referring to FIGS. 1, 2 and 3, the control module 80 includes at least a battery box 81 and a base 82. The battery box 81 has a housing trough 812 and a lid 814 that form a housing space there between to hold at least one battery 83. The housing trough 812 also has a button hole 813 to be run through by a pushbutton 64. The base 82 has a side wedge end 821 to couple with another side of the upper elongated member 20. The base 82 has a holding compartment 822 to hold the motor 51 and the gear box 52 of the electric transmission assembly 50. The base 82 is fastened to the bottom end of the battery box 81.

Figure 4:
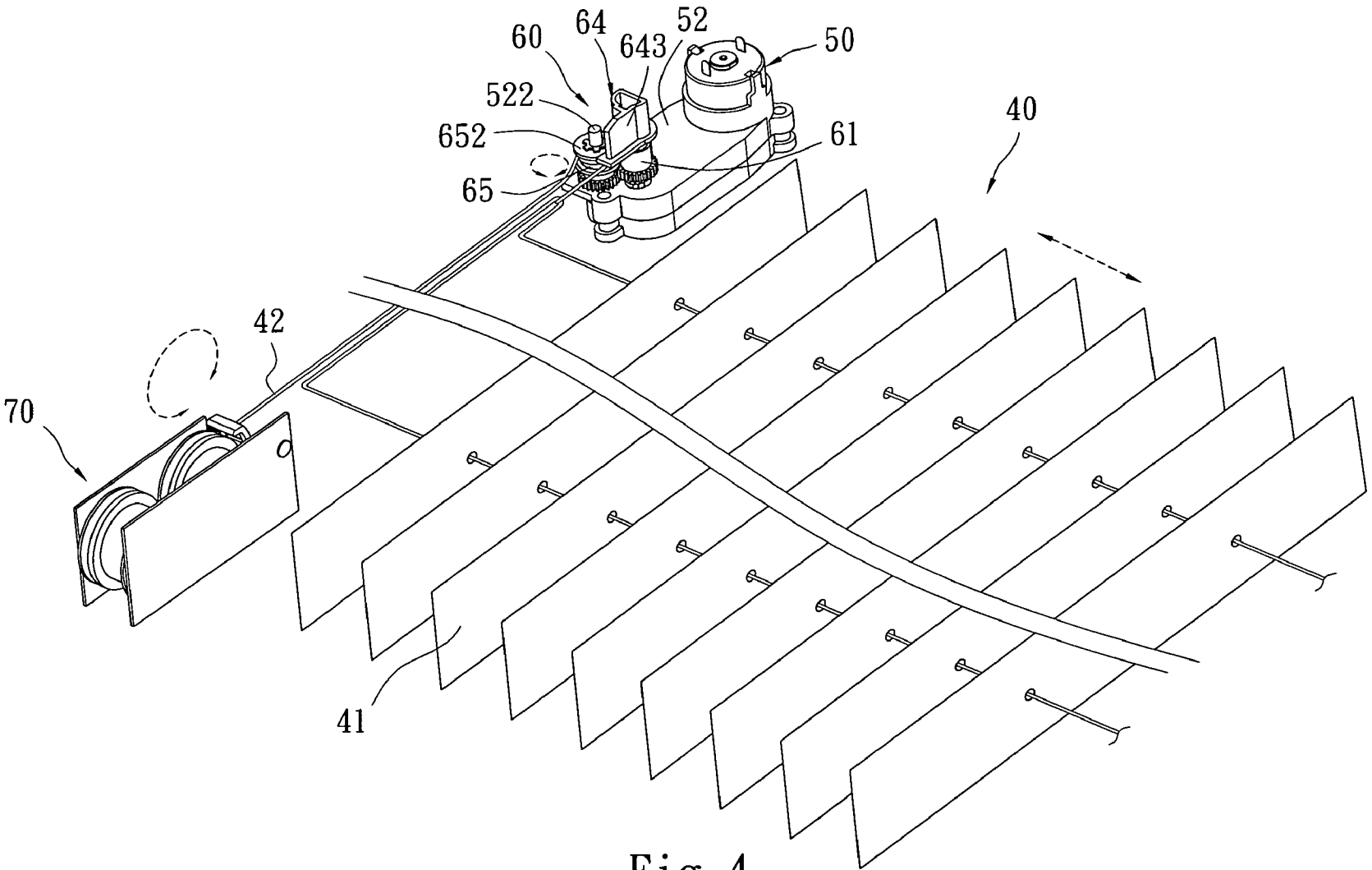
FIG. 4 is a fragmentary perspective view of the invention.
Figure 6:
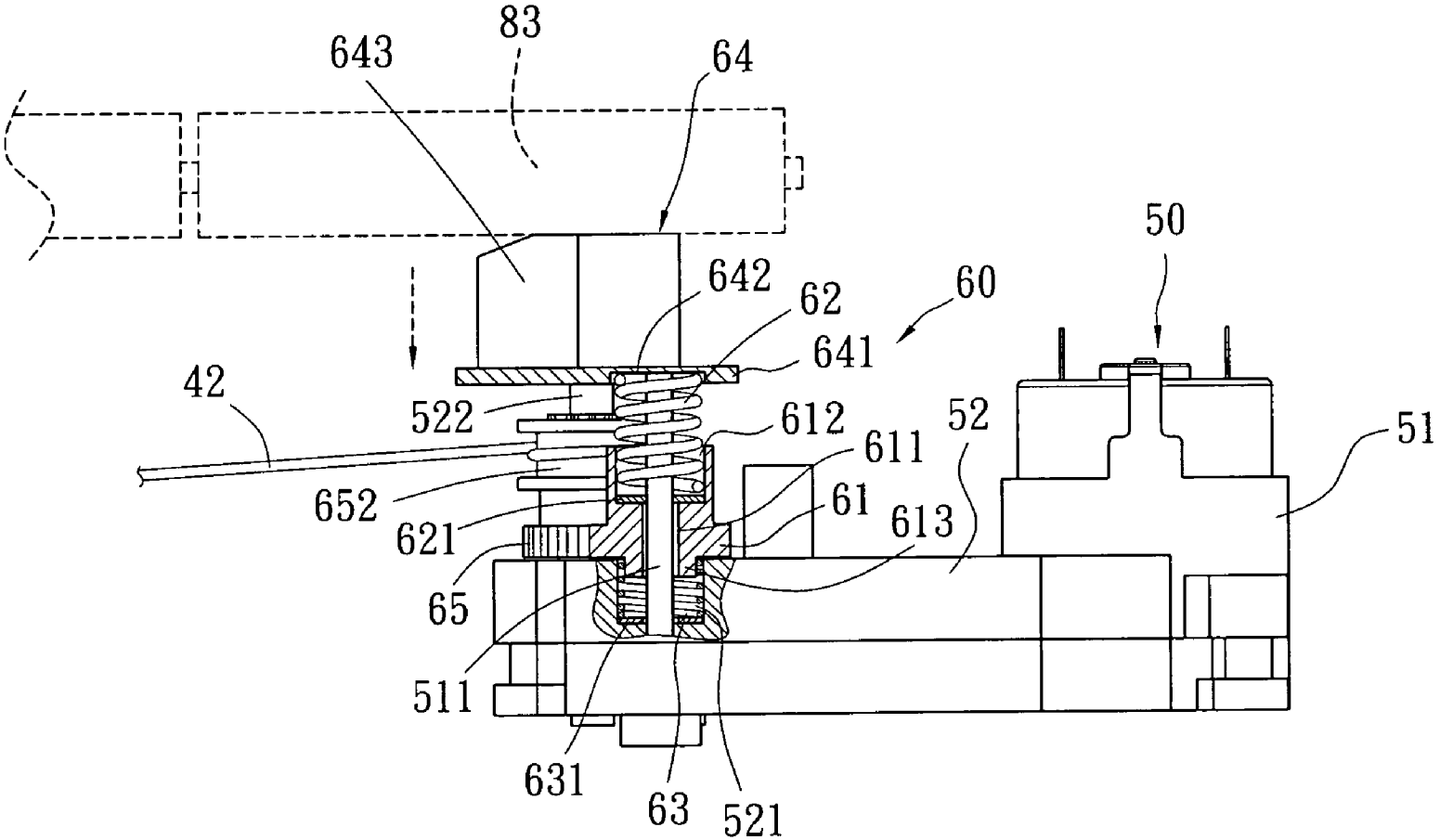
FIG. 6 is a schematic view of the invention showing a pushbutton of the battery is depressed to activate the clutch.
Figure 7:
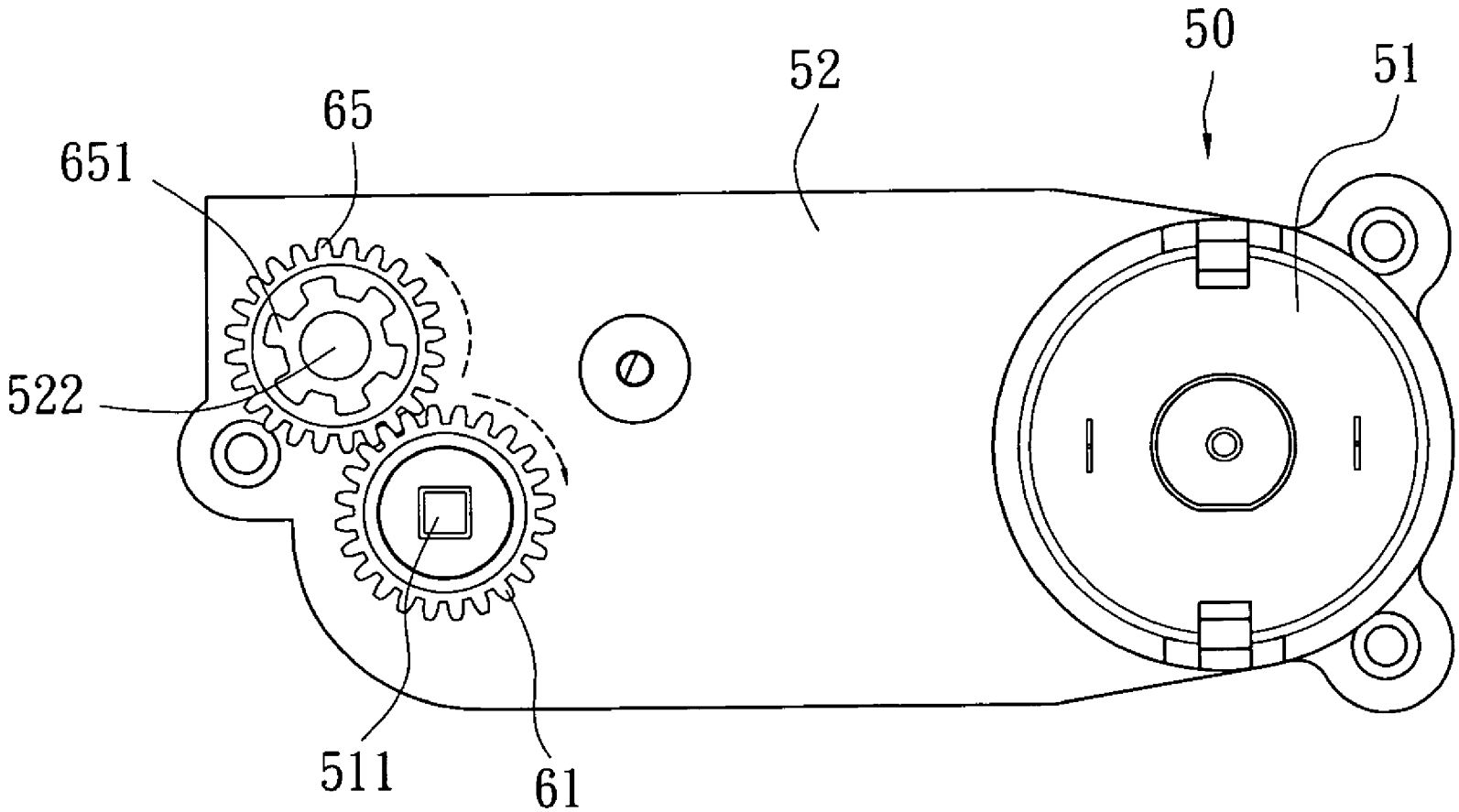
FIG. 7 is a schematic view of the invention showing a driving gear and a driven gear are engaged to perform transmission.

Referring to FIGS. 4, 5 and 6, the clutch 60 is coupled with the axle 511 of the gear box 52 of the electric transmission assembly 50. It includes at least a driving gear 61, an elastic element, the pushbutton 64 and a driven gear 65. In this embodiment the elastic element is a spring 63. The driving gear 61 has a top portion 612 and a bottom portion 613, and an aperture 611 in the center to be run through by the axle 511. The spring 63 has one end pressing the bottom portion 613 of the driving gear 61. The pushbutton 64 has a boss 643 and a bottom 641. The bottom 641 presses the top portion 612 of the driving gear 61. The driven gear 65 is held on the anchor shaft 522 of the gear box 52 and can be engaged with the driving gear 61 to form synchronous transmission. The driven gear 65 has a pulley 652 to be wound by the lift cord assembly 42 so that the pulley 652 can rotate synchronously with the driven gear 65.

Referring to FIG. 3, the boss 643 at the upper end of the pushbutton 64 is formed with a cross section mating the button hole 813 of the housing trough 812 in any geometric shape desired. In FIGS. 2 and 3, the cross section of the boss 643 is substantially formed in a 7-shape with a hollow upper portion.

Referring to FIGS. 1, 4, 6 and 7, the automatic retraction means 70 is located in the upper elongated member 20 at one side. One end of the lift cord assembly 42 is fastened to one side of the automatic retraction means 70. The lift cord assembly 42 has other end winding on the pulley 652, then threading through the upper elongated member 20 to link the shades 41 and fasten to the lower elongated member 30. Thereby the automatic retraction means 70 is coupled with the driven gear 65 hinged on the anchor shaft 522 through the lift cord assembly 42, and the shade lift cord assembly 40 with the shade 41 threaded thereon can be extended or retracted by means of an elastic element (not shown in the drawings) of the automatic retraction means 70. As a result, the shade 41 can be extended or retracted manually.

Referring to FIGS. 1, 2 3 and 5, when the electric window covering 10 is in use to retract and extend the shade 41, the automatic retraction means 70 is coupled with the axle 511 of the gear box 52 of the electric transmission assembly 50 and the clutch 60. When the battery box 81 has the battery 83 held inside, by depressing the pushbutton 64 the driving gear 61 is pushed downwards and the driving gear 61 is moved downwards to engage with the driven gear 65. Thus rotation of the axle 511 also drives the driving gear 61 which in turn drives the driven gear 65 to rotate synchronously. And the shade lift cord assembly 40 threading the shades 41 is driven by the electric transmission assembly 50 and the clutch 60, and the electric window covering 10 can be retracted and extended electrically.

Figure 8:
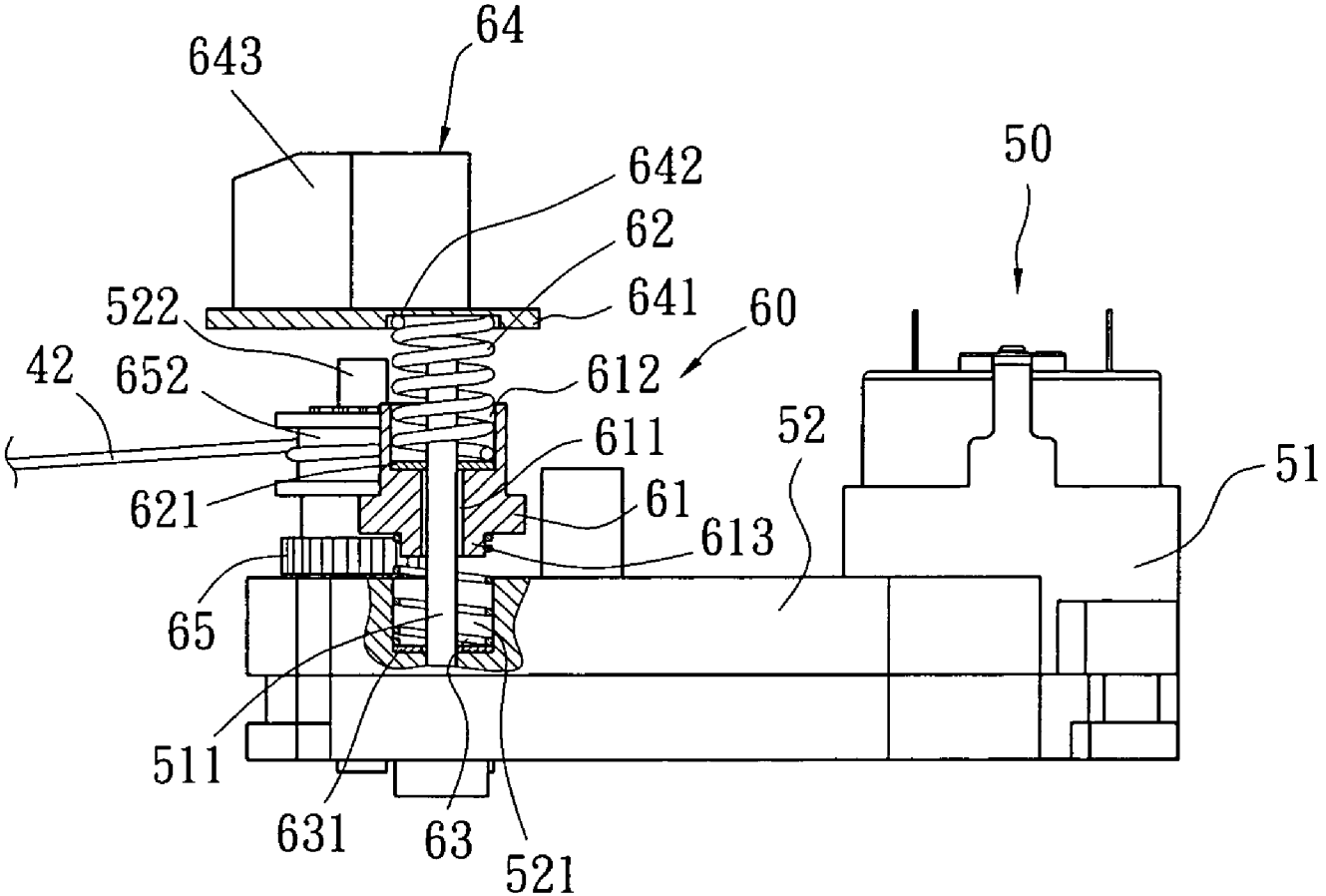
FIG. 8 is a schematic view of the invention without containing the battery and the pushbutton not being depressed.

Referring to FIGS. 1, 3 and 8, when the battery 83 in the battery box 81 is removed, the electric window covering 10 loses electric power. The spring 63 of the clutch 60 pushes the driving gear 61 upwards to disengage with the driven gear 65. Then the electric window covering 10 that originally was driven electrically can be operated manually to cause the shade 41 to be retracted upwards or extended downwards. Thus through the clutch 60 the electric window covering 10 can be operated for retraction and extension as desired, either manually and electrically. Operation is more versatile and convenient.

Figure 9:
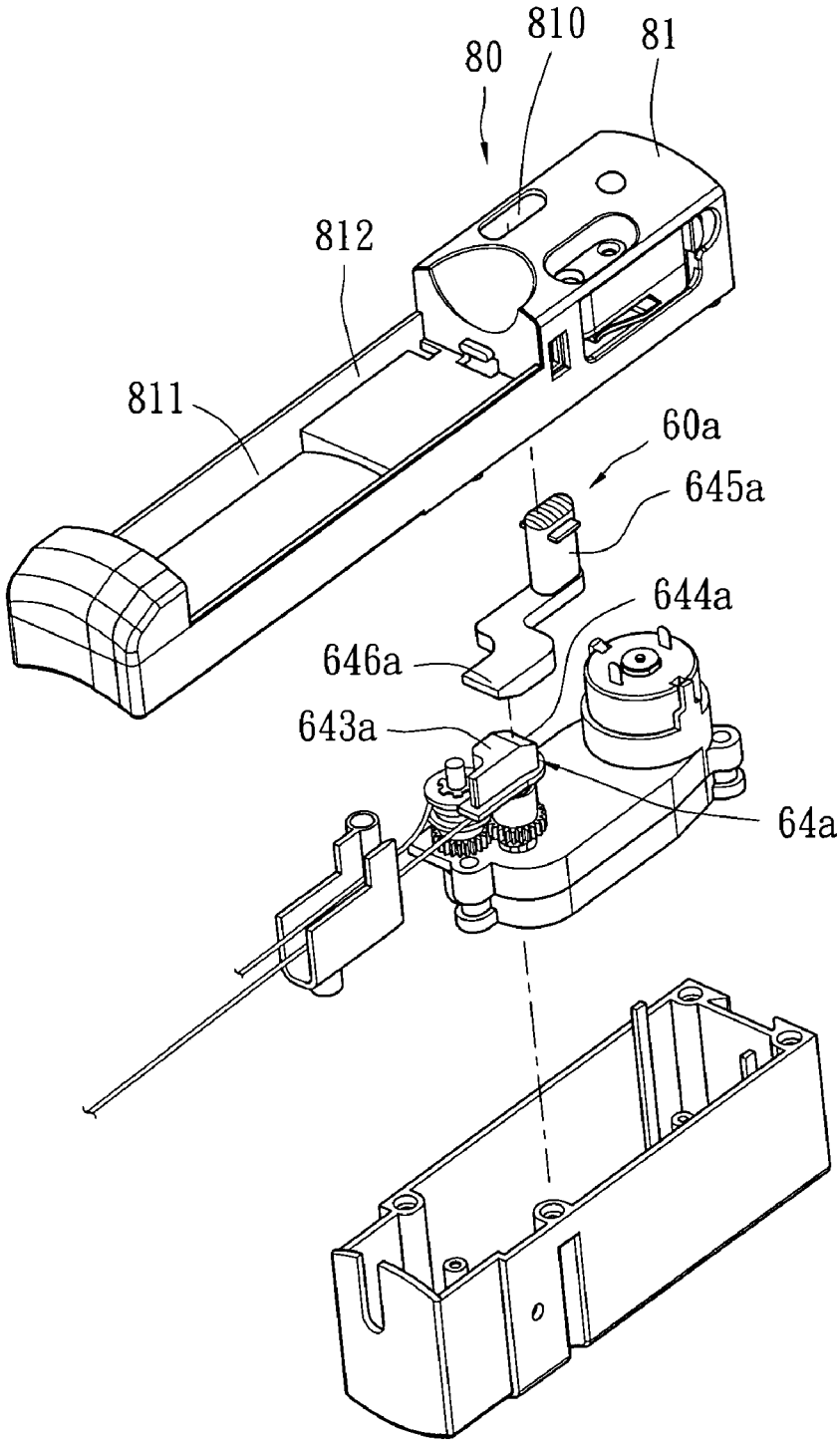
FIG. 9 is an exploded view of a second embodiment of the clutch of the invention.
Figure 11:
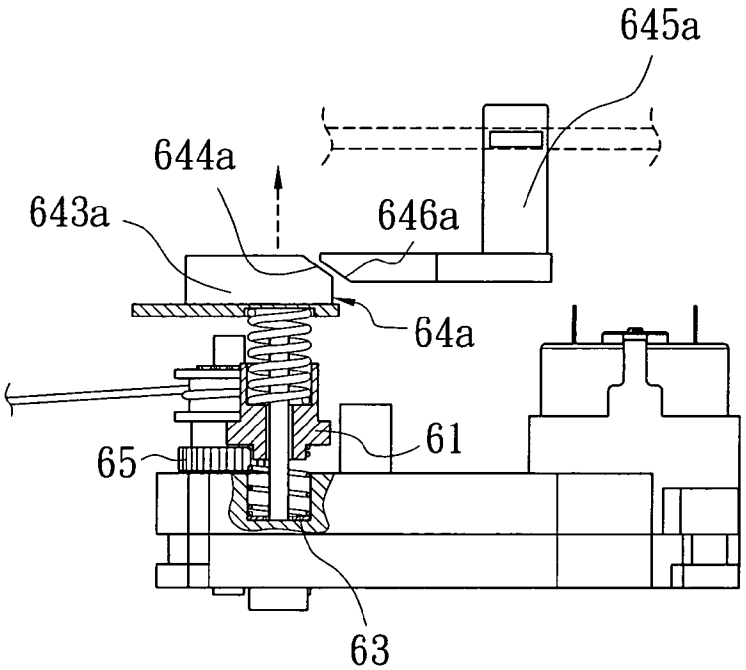
FIG. 11 is a schematic view according to FIG. 9 without containing the battery and the pushbutton not being depressed.
Figure 10:
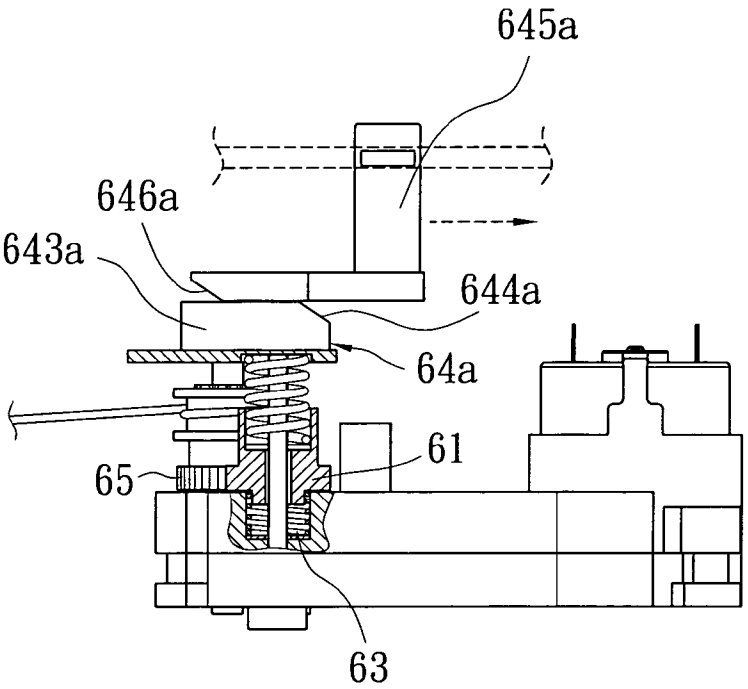
FIG. 10 is a schematic view according to FIG. 9 showing the pushbutton of the battery is depressed to activate the clutch.

Refer to FIG. 9 for a second embodiment of the invention. The clutch 60*a* has a pusher 645*a* which has a slanted surface 646*a* at one end. The pushbutton 64*a* has a boss 643*a* at an upper end thereof that has a slope 644*a* at one end opposing the slanted surface 646*a* such that the slanted surface 646*a* is in contact with the slope 644*a* to press and release the pushbutton 64*a*. The electric window covering 10 has a battery box 81 which has a slot 810 to allow another end of the pusher 645*a* to extend outside the surface of the battery box 81. When the pusher 645*a* is moved on surface of the battery box 81 towards one end, the slanted surface 646*a* presses the pushbutton 64*a*, and the bottom of the pushbutton 64*a* compresses the driving gear 61 to engage with the driven gear 65. Therefore the window covering 10 can be operated electrically. When the pusher 645*a* is moved towards another end the pushbutton 64*a* is released, and the spring 63 pushes the driving gear 61 to escape the driven gear 65 (referring to FIGS. 10 and 11). Then the window covering 10 originally driven electrically can be switched to manual operation.

Figure 12:
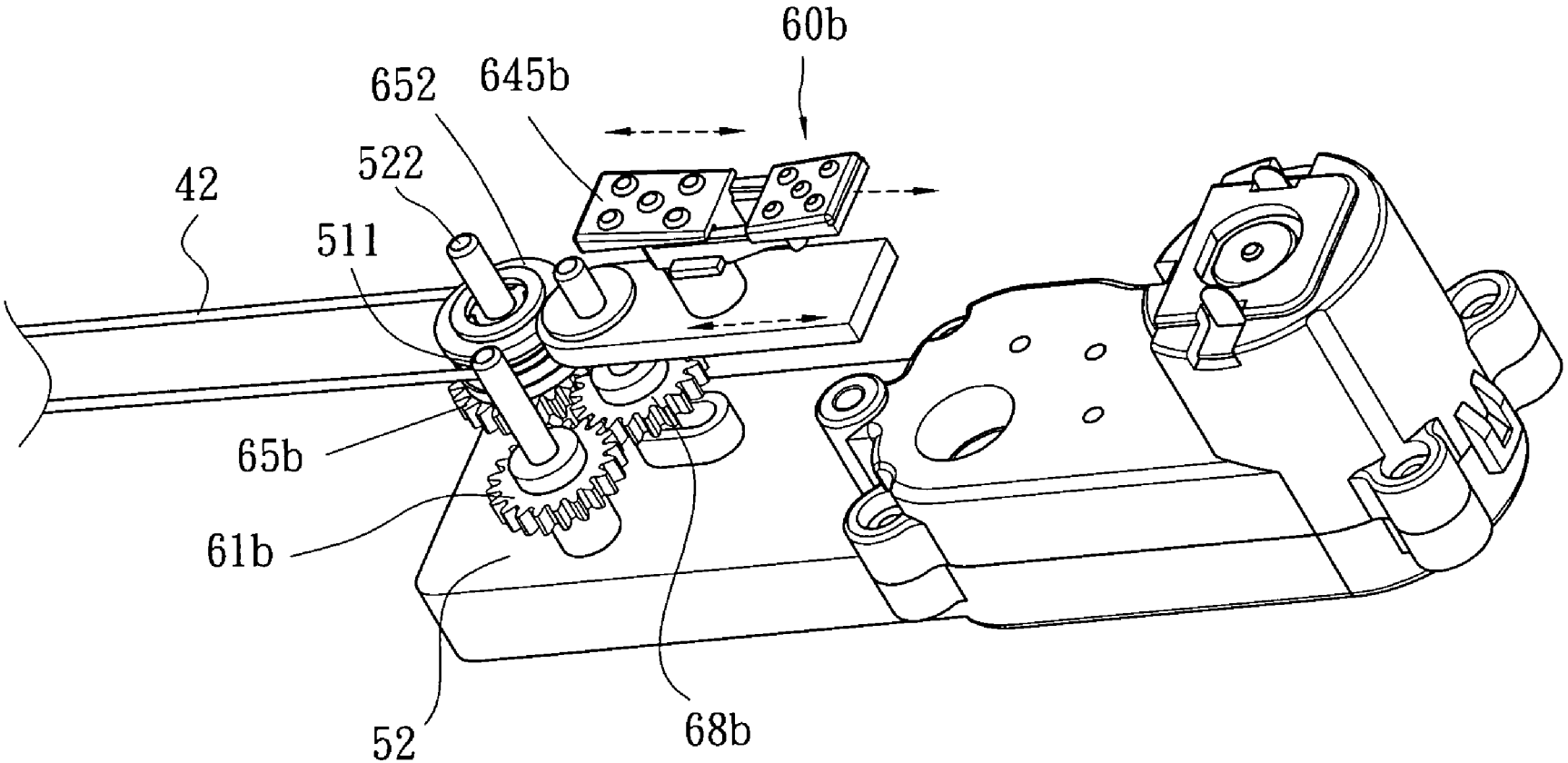
FIG. 12 is a schematic view of a third embodiment of the clutch of the invention.
Figure 13:
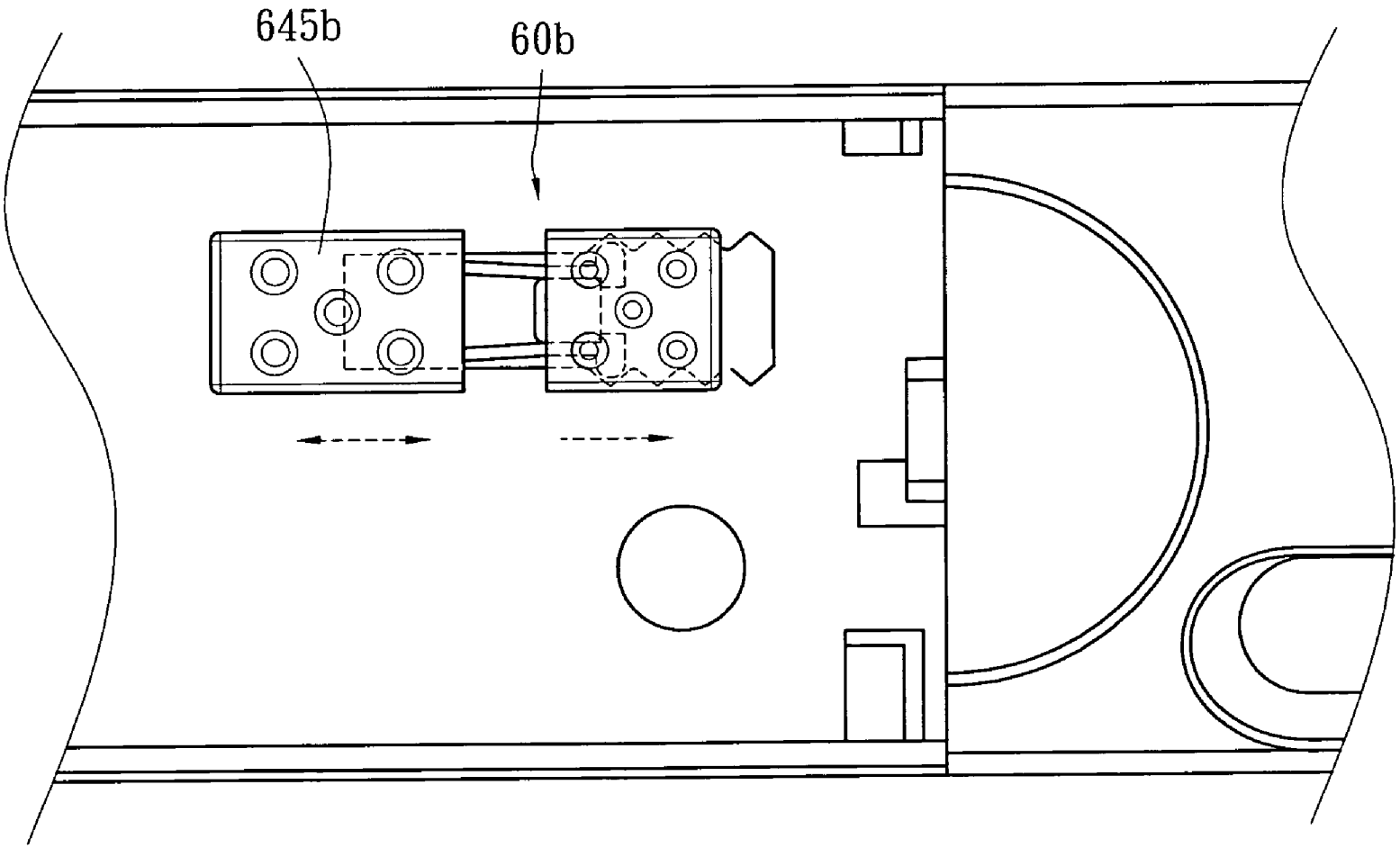
FIG. 13 is a schematic view according to FIG. 12 without containing the battery and a pusher.

Refer to FIGS. 12 and 13 for a third embodiment of the invention. The clutch 60*b* includes at least a driving gear 61*b*, a driven gear 65*b* and a pusher 645*b*. The driving gear 61*b* is mounted onto the axle 511. The driven gear 65*b* is located on the anchor shaft 522 of the gear box 52. The driven gear 65*b* has a pulley 652 wound by the lift cord assembly 42 so that the pulley 652 can be rotated with the driven gear 65*b* synchronously. The pusher 645*b* has one end pivotally coupled with a middle gear 68*b*. The electric window covering 10 has a battery box (not shown in the drawings) same as the battery box 81 shown in the embodiment depicted in FIGS. 3 and 8. The battery box has a slot (not shown in the drawings) to allow another end of the pusher 645*b* to extend outside the surface of the battery box. The pusher 645*b* can be moved towards one end, and the middle gear 68*b* is engaged with the driving gear 61*b* and the driven gear 65*b* at the same time to allow the electric window covering 10 to be operated electrically. When the pusher 645*b* is moved towards another end the middle gear 68*b* is disengaged with the driving gear 61*b* and the driven gear 65*b*. Then the window covering 10 originally driven electrically can be switched to manual operation.

Figure 14:
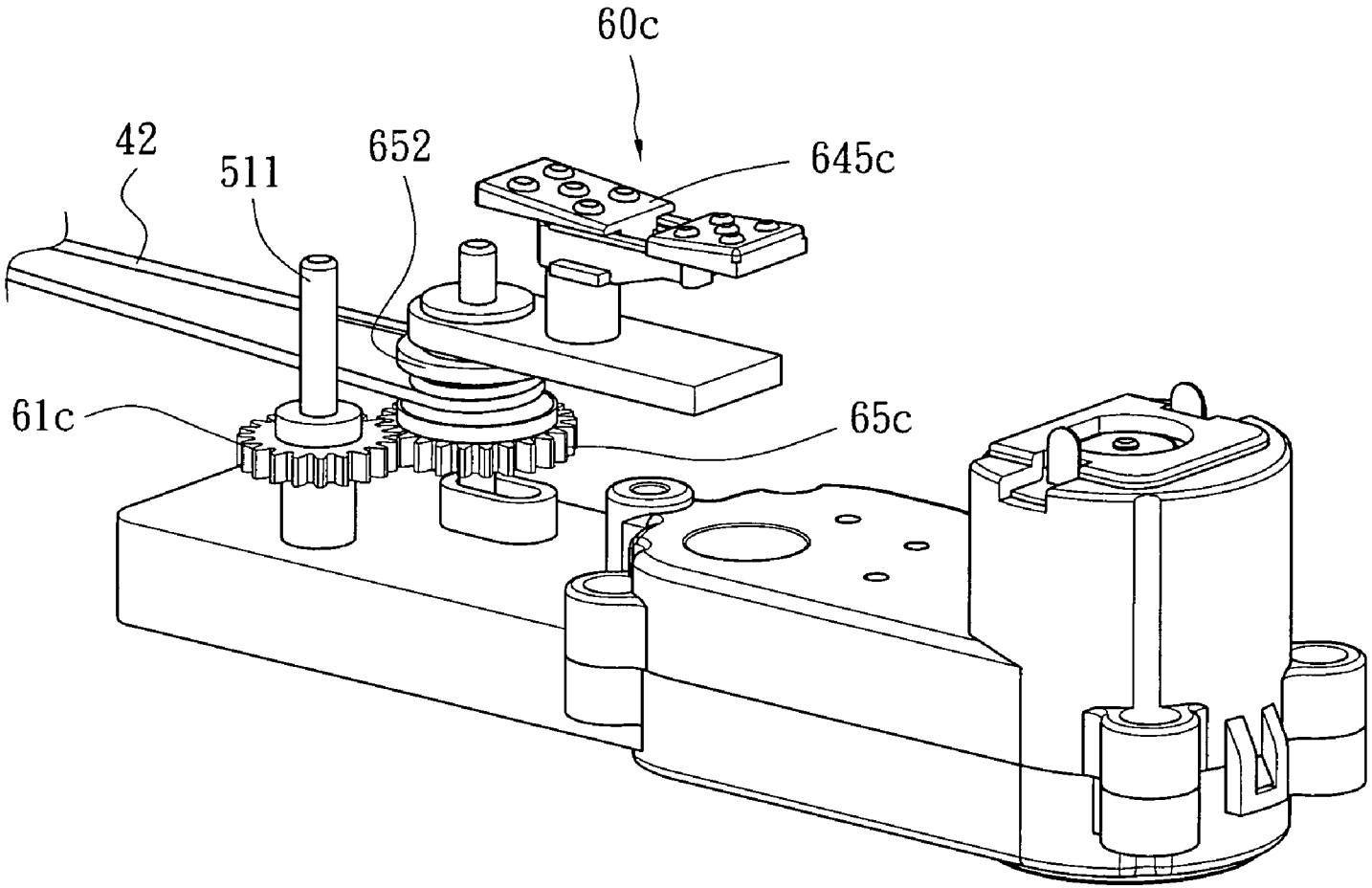
FIG. 14 is a schematic view of a fourth embodiment of the clutch of the invention.

Refer to FIG. 14 for a fourth embodiment in which the clutch 60*c* includes at least a driving gear 61*c*, a driven gear

65*c* and a pusher 645*c*. The driving gear 61*c* is mounted onto the axle 511. The pusher 645*c* has one end pivotally coupled with the driven gear 65*c* which has a pulley 652 for winding the lift cord assembly 42 such that the pulley 652 can rotate with the driven gear 65*c* synchronously. The electric window covering 10 has a battery box (not shown in the drawings) same as the battery box 81 shown in the embodiment depicted in FIGS. 3 and 8. The battery box has a slot to allow another end of the pusher 645*c* to extend outside the surface of the battery box. The pusher 645*c* can be moved towards one end to allow the driving gear 61*c* to be engaged with the driven gear 65*c* so that the electric window covering 10 can be operated electrically. When the pusher 645*c* is moved towards another end the driving gear 61*c* and the driven gear 65*c* are disengaged. Then the window covering 10 originally driven electrically can be switched to manual operation.

What is claimed is:

1. A clutch for an electric window covering which has a lift cord assembly to retract and extend shade, comprising:

a driving gear coupled on an axle; and a driven gear which is hinged on an anchor shaft and has a pulley to be wound by the lift cord assembly;

wherein the driving gear is engaged with the driven gear to allow the electric window covering to be retracted and extended electrically; and the driving gear is also disengaged with the driven gear to allow the electric window covering to be retracted and extended manually;

an elastic element pressing the bottom of the driving gear; and a pushbutton which has a boss and a bottom pressing the driving gear; the pushbutton being depressible to allow the bottom thereof to press the driving gear to engage with the driven gear; releasing the pushbutton causing the elastic element to press the driving gear to be disengaged with the driven gear;

a battery pressing the pushbutton to allow the driving gear to be engaged with the driven gear; the battery being removable to release the pushbutton to allow the elastic element to press the driving gear to be disengaged with the driven gear.

2. The clutch for the electric window covering of claim 1, wherein the electric window covering has a housing trough to hold the battery and a button hole to be run through by the pushbutton.

* * * * *